US006129628A

United States Patent [19]

O'Hagin et al.

[11] Patent Number: 6,129,628

[45] Date of Patent: Oct. 10, 2000

[54] ROOF VENT

[75] Inventors: Harry O'Hagin; Carolina O'Hagin, both of 1349 Cunningham Rd., Sebastopol, Calif. 95472

[73] Assignees: Harry O'Hagin; Carolina O'Hagin, both of Sebastopol, Calif.

[21] Appl. No.: 09/298,648

[22] Filed: Apr. 23, 1999

Related U.S. Application Data

[60] Provisional application No. 60/096,619, Aug. 14, 1998.

[51] Int. Cl.[7] ..... F24F 7/02

[52] U.S. Cl. ..... 454/366; 454/367

[58] Field of Search ..... 454/339, 365, 454/366, 367; 52/199

[56] References Cited

U.S. PATENT DOCUMENTS

| | | | |
|---|---|---|---|
| 311,784 | 2/1885 | Brille . | |
| 1,408,441 | 3/1922 | Caldwell . | |
| 3,027,090 | 3/1962 | Zerhan | 236/49 |
| 3,238,862 | 3/1966 | Smith et al. . | |
| 3,245,224 | 4/1966 | Wilkinson | 62/239 |
| 3,302,554 | 2/1967 | Rousey et al. . | |
| 3,354,808 | 11/1967 | MacRow . | |
| 3,382,792 | 5/1968 | Howard . | |
| 3,683,785 | 8/1972 | Grange . | |
| 3,862,529 | 1/1975 | Markos | 52/199 |
| 3,934,383 | 1/1976 | Perry et al. | 52/200 |
| 4,123,968 | 11/1978 | Malott . | |
| 4,138,935 | 2/1979 | Vallee . | |
| 4,181,690 | 1/1980 | Neu | 261/29 |
| 4,483,102 | 11/1984 | Edwards | 49/465 |
| 4,545,291 | 10/1985 | Kutsch et al. | 454/365 |
| 4,867,046 | 9/1989 | Yoder . | |
| 4,962,692 | 10/1990 | Shuert | 98/42.21 |
| 5,050,489 | 9/1991 | Mankowski | 454/366 X |
| 5,094,054 | 3/1992 | Arends | 52/302 |
| 5,095,810 | 3/1992 | Robinson | 454/365 |
| 5,149,301 | 9/1992 | Gates | 454/365 |
| 5,326,318 | 7/1994 | Rotter | 454/365 |
| 5,561,953 | 10/1996 | Rotter | 52/198 |
| 5,603,657 | 2/1997 | Sells | 454/359 |
| 5,673,521 | 10/1997 | Coulton et al. | 52/199 |
| 5,707,283 | 1/1998 | Oberreuter et al. | 454/259 |
| 5,782,051 | 7/1998 | LaVoie | 52/473 |

FOREIGN PATENT DOCUMENTS

| | | | |
|---|---|---|---|
| 2 683 570 | 11/1991 | France . | |
| 2 199 860 | 7/1986 | United Kingdom | 454/366 |
| 2 187 222 | 2/1987 | United Kingdom . | |

OTHER PUBLICATIONS

International Search Report, PCT/US99/18529.

*Primary Examiner*—Harold Joyce
*Attorney, Agent, or Firm*—Limbach & Limbach L.L.P.

[57] ABSTRACT

A roof vent comprises a base defining an air outlet/inlet portion, a cover having at least one exterior louvre for air flow, a side wall connecting the base and cover, and an interior louver between the exterior louvre and the air inlet/outlet portion with at least one and preferably two strips having slats configured such that matter passing through the vent must substantially traverse the interior louvre. The interior louvre is preferably perpendicular to the exterior louvre. The interior louvre contacts the base and the cover to provide support along with the side wall. A supporting rib may be added for additional support. The cover preferably has a second exterior louvre. A second interior louvre is located between the second exterior louvre and the air inlet/outlet portion such that matter must substantially traverse the second interior louvre if it is to pass through the vent via the second exterior louvre. The side wall preferably has an opening, and a third interior louvre is located between this opening in the side wall and the air inlet/outlet portion such that matter must substantially traverse the third interior louvre to flow through the vent via the opening in the side wall. Air flow is enabled between the air outlet/inlet portion and the outer atmosphere, or vice-versa, via any of the first and second interior louvres and the first and second exterior louvres, respectively, and the third interior louvre and the opening in the side wall. Water and other solid, liquid and particle contaminants are substantially prevented by the louvres from passing through the vent while air flow and mechanical support are facilitated by the multiple interior/exterior louvre pair design.

19 Claims, 4 Drawing Sheets

ROOF VENT

This application claims benefit of provisional application Ser. No. 60/096,619 filed Aug. 14, 1998.

FIELD OF THE INVENTION

The invention relates to a roof vent, and particularly to a roof vent for composition shingled roofs.

BACKGROUND OF THE INVENTION

Roof vents are employed as integral parts of a useful roof design. Roof vents are most often used for equalizing the pressure and/or the temperature between the interior and the exterior of a building. To do this, the vent provides a passage for air to flow out of a house, building, warehouse, attic or otherwise unventilated room or area to the outside and vice-versa. A desirable roof vent also inhibits liquid and solid contaminants, particularly water, traversing through the openings which allow the air to flow. In addition, a desirable roof vent is structurally sound such that it may withstand the pressure of high winds, heavy snow or other debris which might crush or pull apart a vent having an unsatisfactory design. It is desired to have a roof vent exhibiting all three of these features. It is further desired to have such a vent which also which fits discretely under the tiles of a typical clay or concrete tile roof.

A previous roof vent design of O'Hagin's, Inc. includes a base with an air inlet/outlet opening to the interior of a building and a cover having exterior louvres through which air might flow through the interior of the vent and through the air inlet/outlet opening. Structural support is provided by side walls of the vent connecting at edges of the cover and base and a compact design. Solid contaminants and water are inhibited from traversing the vent by a wire screen or mesh over the air inlet/outlet opening, and by the design of the exterior louvres.

U.S. Pat. No. 5,772,502 to Smith discloses a ridge vent which has portions lying on either side of a ridge and rows of exterior louvre-shaped air passages on the cover of the vent to provide passages for air flow through the vent. A roofline ventilator having rows of louvres opening downwardly and outwardly are disclosed in U.S. Pat. No. 4,545,291 to Kutsch et al. A roof ventilator is also disclosed by U.S. Pat. No. 3,238,862 to L. L. Smith et al. having side walls with louvres and a bell-shaped cover configured to allow air to flow through the louvres in the side walls to the outside, while still inhibiting water and other contaminants from passing through the vent.

U.S. Pat. No. 311,784 shows a skylight having openings through two of which light or air might pass without providing an avenue for water to get in. Another roof ridge vent is disclosed in U.S. Pat. No. 4,962,692 to Shuert having an opening in the gravitationally-speaking bottom-most facing portion of the vent to allow air to flow downwardly out of the vent from the interior of a building. As water flows in the direction of gravity, this opening does not allow water to get into the vent in the absence of excessive wind.

SUMMARY OF THE INVENTION

The present invention provides a roof vent for composition tile roofs, comprising a base having an air outlet/inlet opening defined therein, a cover having at least a first exterior louvre with several openings for air flow, a side wall substantially sealing the interior of the vent by connecting the base and cover, and a first interior louvre between the first exterior louvre and the air inlet/outlet portion. The first interior louvre preferably includes one or two structural strips. Preferably, the first interior louvre is substantially perpendicular to the first exterior louvre to provide maximum structural support and air flow. The first interior louvre and the side wall together provide support and prevent the vent from collapsing under heavy debris or pulling apart in high wind.

Summarizing a preferred embodiment of the present invention, a roof vent comprises a base having an air outlet/inlet opening defined therein, a cover having at least a first exterior louvre with several openings or slats for air flow, a side wall substantially enclosing the interior of the vent by connecting the base and cover, and a first interior louvre between the first exterior louvre and the air inlet/outlet portion. The first interior louvre preferably includes one or two structural strips. Also preferably, the first interior louvre is substantially perpendicular to the first exterior louvre to provide maximum structural support and air flow. The first interior louvre and the side wall together provide support and prevent the vent from collapsing under heavy debris or pulling apart in high wind.

A second exterior louvre is preferably defined in the cover. A second interior louvre is provided through which air must substantially traverse to flow between the air inlet/outlet opening and the second exterior louvre. The second interior louvre is located between the second exterior louvre and the air inlet/outlet portion to provide another avenue of air flow and further structural support. A supporting rib may be added for additional structural support.

The side wall preferably has an opening to be positioned at a lowest position on the vent relative to gravity. A third interior louvre is then located between this opening in the side wall and the air inlet/outlet opening. This third combination provides still enhanced air flow and further structural support.

Thus, in the preferred embodiment, air flow is enabled between the air outlet/inlet portion and the outer atmosphere via any of the first and second interior louvres and the first and second exterior louvres, respectively, and the third interior louvre and the opening in the side wall. Water and other solid, liquid and particle contaminants are inhibited from passing through the vent while air flow and mechanical support are facilitated by the multiple interior/exterior louvre pair design.

DETAILED DESCRIPTION OF THE PREFERRED EMBODIMENT

Preferred and alternative embodiments of the present invention are now described in detail with reference to the drawings. It is noted that the drawings include some preferred dimensions not otherwise discussed below, and around which the invention is not limited. Moreover, the drawings include elements which are not recited in the claims, and not intended as being required features of the invention. To be clear, it is intended that the invention be defined by the appended claims and not by anything otherwise described in this application.

Figure 1:
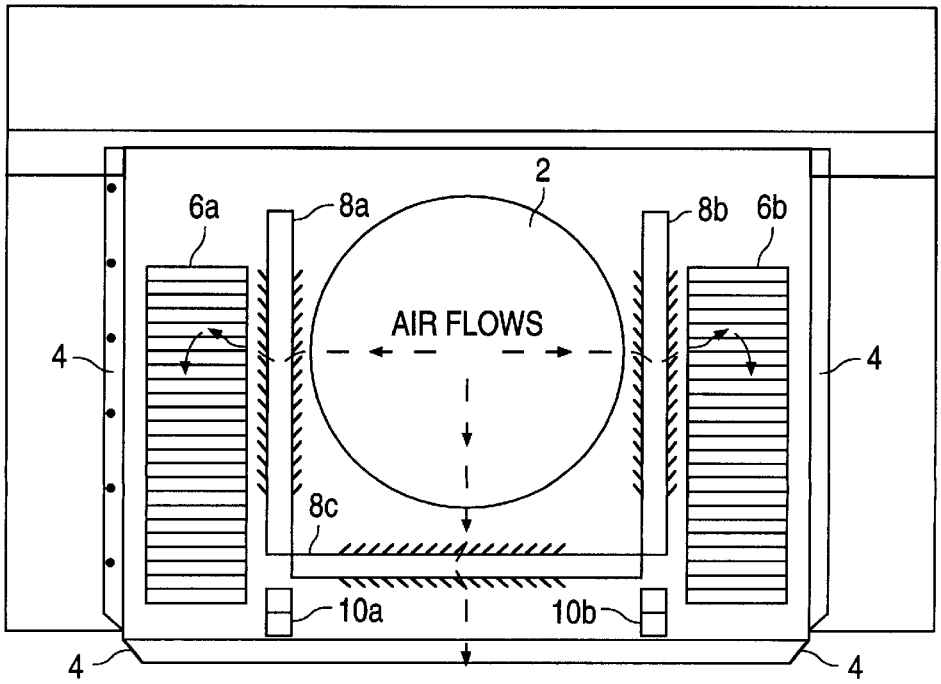
FIG. 1 is a top view of a roof vent according to a preferred embodiment of the present invention.
Figure 2:
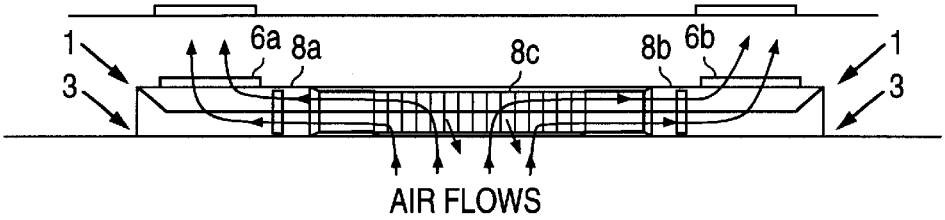
FIG. 2 is a front view of the roof vent of FIG. 1 further showing a preferred direction of air flow through two pairs of interior/exterior louvers, and also through the opening in the side wall via an additional interior louvre.

FIG. 1 schematically shows a top view of a roof vent according to a preferred embodiment of the present invention and should be viewed together with FIG. 2 to get an understanding of the vent as a whole. FIG. 1 allows interior elements of the vent to be observed as if the cover 1 of the vent were transparent, even though the cover 1 preferably instead comprises an opaque metal, to illustrate interrelationships of between interior and exterior elements of the vent.

Specifically, an air inlet/outlet opening 2 is provided in a base 3 portion of the vent. The base 3 is substantially planar and positioned in contact with the plane of a roof. The inlet/outlet opening 2 is to be positioned over a complementary opening in the roof itself such that air may flow between the interior of the building upon which the vent is located and the interior of the vent through the overlaid opening in the roof and the inlet/outlet opening 2 of the base 3 of the vent. The opening 2 preferably has means to prevent solid contaminants from passing through it such as a wire screen or mesh overlaying it. A short lip (not shown) may be formed around a portion of the opening 2 of the base, or around the entire opening, the keep water from flowing into the opening 2 by diverting it around the opening.

A cover 1 portion of the vent is also substantially planar and has similar dimensions as the base 3. The cover 1 is also positioned parallel to the plane of the roof and the plane of the base 3. The cover 1 is spaced apart from the base 3 (i.e., the vent is supported) in part by side walls 4 which preferably connect and seal the base 3 and cover 1 at the edges of the base 3 and cover 1.

The cover 1 includes one or more, and preferably two, exterior louvres 6*a*,6*b* or rows of openings through which air may pass, and which are configured to inhibit solids and liquids from passing through. In that regard, the openings of the louvres 6*a*,6*b* are preferably cut from the cover 1 along a line from left-to-right (or right-to-left) to a person observing the vent while standing closest to the front of the vent. The openings of the louvres 6*a*,6 are bent outwardly such that the outward pointing portions point mostly in the direction of the flow of water, or downward toward low gravitational potential. The exterior louvres 6*a* and 6*b* are preferably located on either side of the opening 2 in the base 3 with sufficient spacing to allow the interior louvres 8*a* and 8*b* (see below) to be positioned between the opening 2 in the base 3 and the exterior louvres 6*a*, 6*b*.

In the interior of vent, and also in reality unobservable from the view of the roof vent of FIG. 1 preferably having an opaque metal cover, is one or more, and preferably two or three, interior louvres 8*a*–8*c*. Three are shown in the preferred embodiment of FIG. 1. The interior louvres 8*a*–8*c* each preferably have two rows of openings as shown. Alternatively, the interior louvres 8*a*–8*c* of the vent may comprise only one row of openings. The louvres are preferably directed such that they are inverted for optimum deflection of wind driven rain, particularly by the outer row of inverted louvres. The two rows of openings provide greater structural support for the vent than the one row design and an extra barrier for undesirable material to overcome to pass through the vent. The interior louvres 8*a*–8*c* are preferably attached to the underside of the cover 1 by coining or clinching. A preferred approach would be to compress the metallic cover I into the louvres 8*a*–8*c*, and then expand the compressed portion to form a lock of the two metals joined.

As mentioned above, the interior louvres 8*a*–8*b* are positioned such that air passing between the exterior louvres 6*a*–6*b* must substantially pass through corresponding interior louvres 8*a*–8*b*, respectively. Moreover, air passing through any of the interior louvres 8*a*, 8*b* or 8*c* must substantially pass through both of the rows of openings in the interior louvres 8*a*–8*c*, as the air passes between the opening 2 in the base 3 and the exterior louvres 6*a*–6*b* or the opening 9 in the side wall 4 (see below), respectively. Likewise, water or solid matter would also substantially have to do so.

The front of the vent is preferably open, or at least, the side wall 4 at the front is formed to define an opening 9. The opening is located at a lowest side of the vent relative to gravity, or at a point of lowest gravitational potential of the vent. In this way, rain and other undesirable foreign matter may not easily get into the vent absent a strong wind. The opening 9 at the front of the vent is a third means, together with the exterior louvres 6*a* and 6*b* for air to pass from the outside to the interior of the vent, or vice-versa.

A third interior louvre 8*c* is positioned between the air inlet/outlet opening 2 and the opening 9 at the front of the vent. Similar to the function of each of the other interior louvres 8*a* and 8*b*, the third interior louvre 8*c* provides further structural support for the vent. The third louvre 8*c* also serves as a barrier for water and other contaminants to overcome to pass between the opening 9 at the front and the opening 2 in the base.

The third interior louvres is also preferably connected at each end to one of the other interior louvres 8*a*,8*b*, as shown in FIG. 1. By connecting the interior louvres 8*a*–8*c* in this way, any matter flowing through the vent from the opening 2 and one of the exterior louvres 6*a*–6*b* or the opening 9, is further restricted to flowing through one of the interior louvres 8*a*–8*c*. In this regard, the interior louvres 8*a* and 8*b* may each be extended to the side wall 4 (at the top of FIG. 1) to prevent matter from bypassing the interior louvres 8*a*–8*c* by going around the end which is not connected to the third interior louvre 8*c* of one of interior louvres 8*a*–8*b*. However, it is recognized that only air and not liquids or solids will be able to easily flow along this path bypassing the interior louvres 8*a*–8*c* because, in the absence of high winds or other external forces, liquids and solids cannot easily move against the force of gravity.

Two further spacer brackets 10*a* and 10*b* are also shown in FIG. 1. The spacer brackets provide additional support to the vent and maintain the spacing between the cover 1 and the base 3.

FIG. 2 is a front view of the roof vent of FIG. 1 further showing a preferred direction of air flow. A first air passage route is from the opening 2 in the base 3, through the first interior louvre 8*a* and out the first exterior louver 6*a*. A second air passage route is from the opening 2 in the base 3, through the second interior louvre 8*b*, and out the second exterior louvre 6*b*. A third air passage route is from the opening 2 in the base 3, through the third interior louvre 8*c*, and out through the opening 9 in the side wall 4 at the front of the vent (out of the page). The combination of the interior louvres 8*a*–8*c* and the exterior louvres 6*a*–6*b* or the downward facing opening 9 yields a low probability that liquid and solid material will traverse the vent to enter the building via the opening 2 in the base 3. Moreover, the interior louvres 8*a*–8*c* provide extraordinary structural support for the vent, together with the side walls 4 and optionally the brackets 10*a*–10*b*. Furthermore, air flow is facilitated in the preferred embodiment by three air flow paths.

Figure 3A:
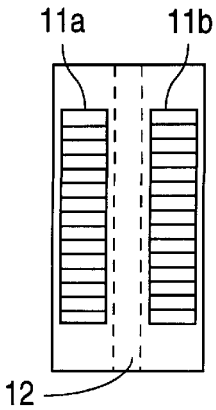
FIG. 3A shows a metallic sheet having two rows of openings prior to being bent to form one of the first and second interior louvres of the roof vent of FIGS. 1 and 2.

FIG. 3A shows a metallic sheet having two rows of openings 11*a*,11*b* prior to being bent to form one of the first and second interior louvres 8*a* and 8*b* of the roof vent of FIGS. 1 and 2. Each of the two rows of openings 11*a*,11*b* of the preferred interior louvres 8*a*–8*c* is initially cut in a flat sheet of preferably metallic material. The cuts are made and the metal pieces bent outward from each cut to form an acute angle with the plane of the sheet. A spacing 12 is provided between each of the two rows of openings 11*a*,11*b* of the sheet. Then the sheet is bent in two places to form a U-shaped louvre 8*a*–8*c* (see FIG. 3C) which may be used as an interior louvre 8*a*–8*c* of the roof vent of FIG. 1.

Figure 3B:
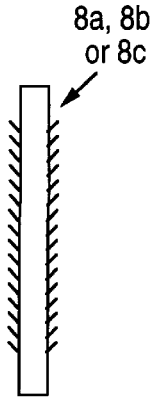
FIG. 3B shows a top view of an interior louver after being bent.
Figure 3C:
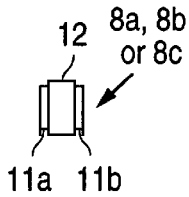
FIG. 3C shows a front view of the interior louver of FIG. 3B.

FIG. 3B shows a top view of an interior louver 8*a*–8*c* after being bent from the flat sheet of FIG. 3A. It is observed in FIG. 3B how the metal pieces are cut and bent from the sheet of FIG. 3A in each row to provide the rows of openings 11*a*,11*b*, and how they are spaced relative to each other and those of the other row. FIG. 3C shows a front view of the interior louver 8*a*–8*c* of FIG. 3B. It is observed from FIG. 3C how two support members (the two legs of the U-shape) will provide support to the vent once positioned between the base 3 and cover 1 of the vent, and how materials must substantially flow between an opening in each row to traverse an interior louvre 8*a*–8*c* .

Figure 3D:
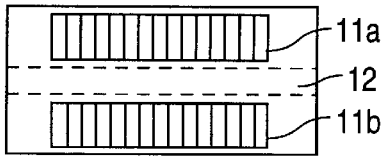
FIG. 3D shows a metallic sheet having two rows of openings prior to being bent to form the third interior louvre.

FIG. 3D shows a metal sheet prior to being bent to form the third interior louvre 8*c*. Preferably, the third interior louvre 8*c* is the same dimensionally as the first and second interior louvres 8*a*,8*b*. FIG. 3D may differ from FIG. 3A by the sheet of FIG. 3D being shorter than that of FIG. 3A. Thus, the third interior louvre 8*c* would be shorter than the first interior louvre 8*a*.

Figure 4E:
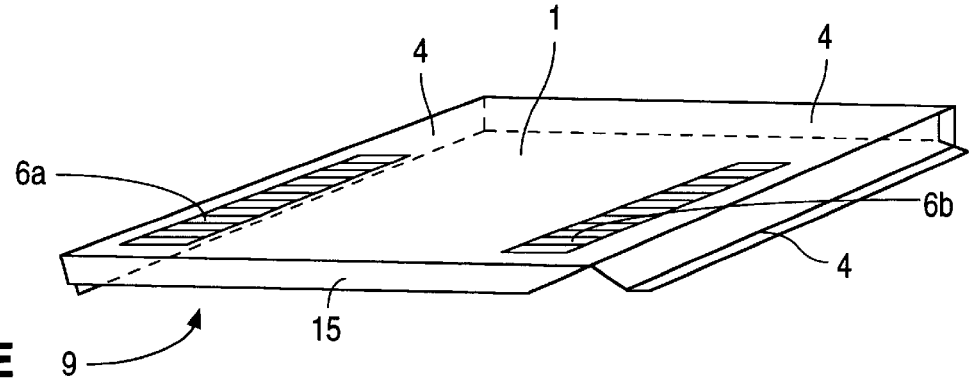
FIG. 4E shows the cover of the roof vent of FIGS. 1 and 2.
Figure 4D:
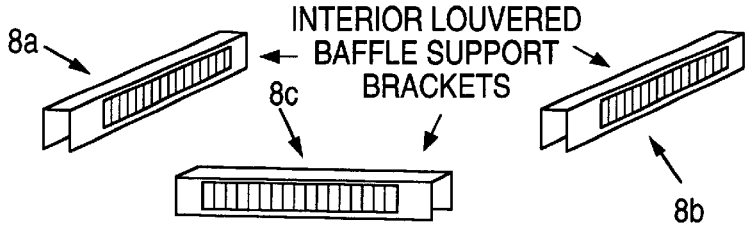
FIG. 4D shows three interior louvers of the roof vent of FIGS. 1, 2 and 3A–3D.
Figure 4C:
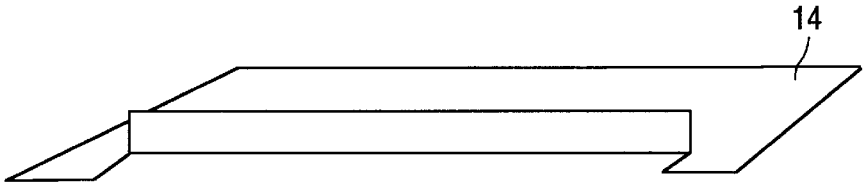
FIG. 4C shows a top flange of the roof vent of FIGS. 1 and 2.
Figure 4B:
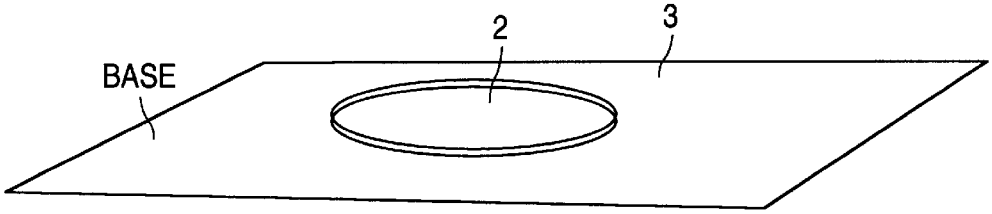
FIG. 4B shows a base of the roof vent of FIGS. 1 and 2.
Figure 4A:
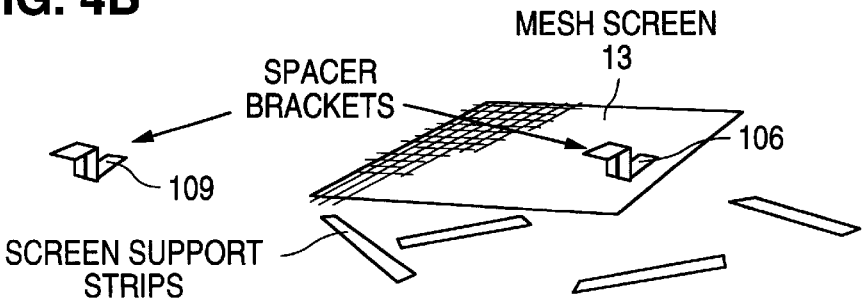
FIG. 4A shows a mesh screen and spacers of the roof vent of FIGS. 1 and 2.

FIGS. 4A–4E show an exploded view of the roof vent according to the preferred embodiment. FIG. 4A shows a mesh screen 13 and spacer brackets 10*a* and 10*b* of the roof vent of FIGS. 1 and 2. The mesh screen 12 is placed over the opening 2 (see FIG. 1) in the roof to prevent material from falling into the interior of the building should it first traverse the interior louvres 8*a*–8*c* of the vent. The spacer brackets 10*a* and 10*b* provide support for the vent and/or maintain the spacing between the cover 1 and base 3.

FIG. 4B shows a base 3 of the roof vent of FIGS. 1 and 2. The base 3 includes the opening 2 as described above with respect to FIGS. 1 and 2. An optional top flange 14 is shown in FIG. 4C. The top flange functions to provide support and also to prevent water and other contaminants from entering the vent opening 2 from the back of the vent (from the top of a roof, e.g.). FIG. 4D shows three interior louvers 8*a*–8*c* of the preferred roof vent described above regarding FIGS. 1 and 2.

FIG. 4E shows the cover 1 of the preferred roof vent. The opening 9 at the front of the vent is shown at the bottom portion of the wall 15 at the front of the vent. In that regard, the front wall 15 of the vent is shorter than the walls 4 at the other three sides. Moreover, the front wall 4 preferably does not contact the base 3 as the other three walls 4 do. Alternatively, the opening 9 could extend from the base 3 of the vent, and not extend to the cover 1. Also alternatively, the opening 9 could be at the center of the front wall 15.

Figure 5A:
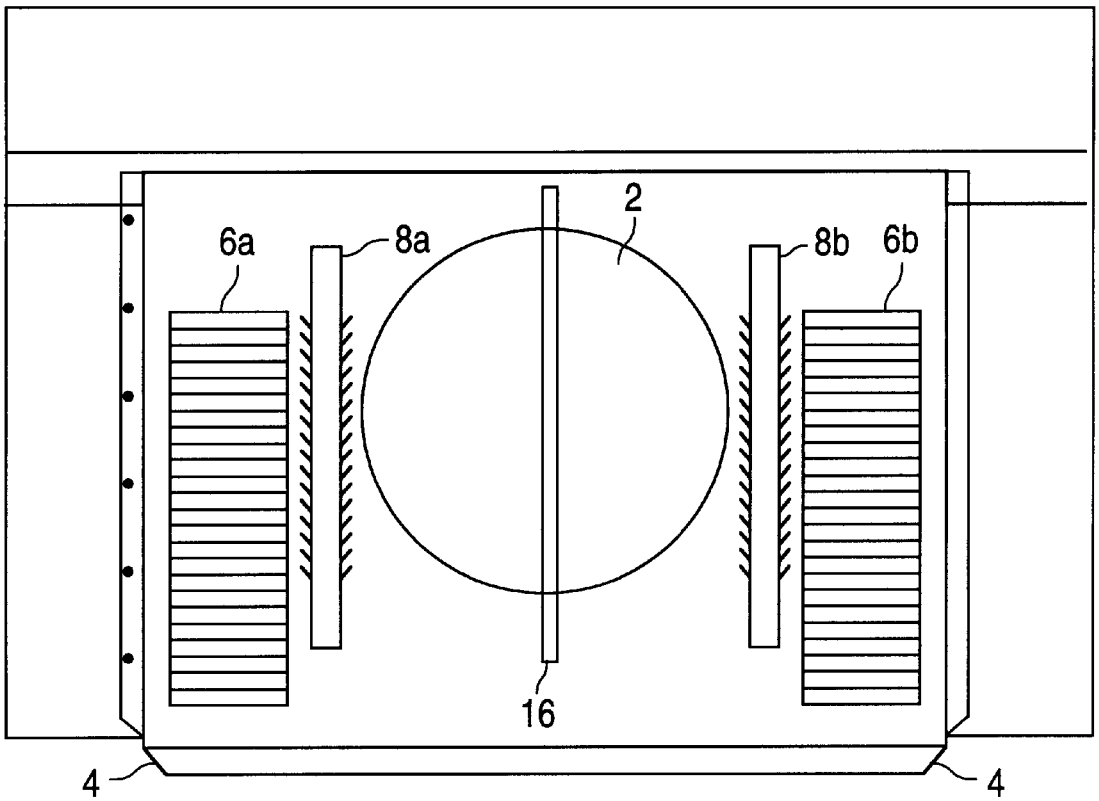
FIG. 5A shows a top view of an alternative embodiment of the roof vent of the present invention.
Figure 5B:
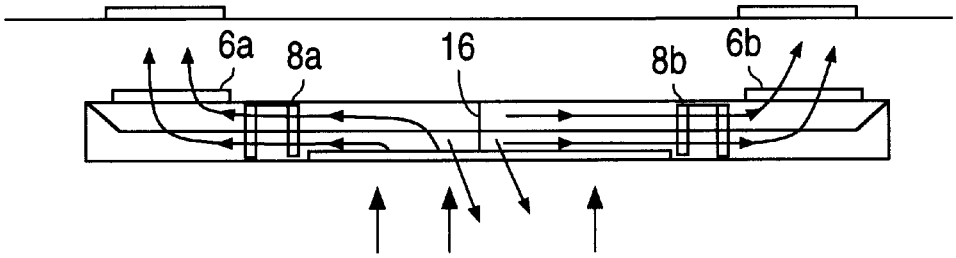
FIG. 5B shows a front view of the roof vent of FIG. 5A.

FIGS. 5A and 5B show a top and front view, respectively, of an alternative embodiment of the roof vent of the present invention. The difference between the alternative embodiment of FIGS. 5A and 5B and the preferred embodiment of FIGS. 1 and 2 are described below.

The roof vent of FIGS. 5A and 5B includes a center rib 16 which provides mechanical support. The center rib 16 is attached to the cover in FIG. 5B, but may be attached to the base 3 or to both the cover 1 and the base 3. Although a third interior louvre 8*c* such as that shown in FIGS. 1 and 2 is not shown in FIGS. 5A and 5B, one may be provided in the alternative embodiment. If a third interior louvre 8*c* is provided, then an opening 9 would also be provided in the front of the vent. In that regard, the alternative embodiment could be formed to be the same as the preferred embodiment of FIG. 1, with the additional rib 16 added for support.

Figure 6C:
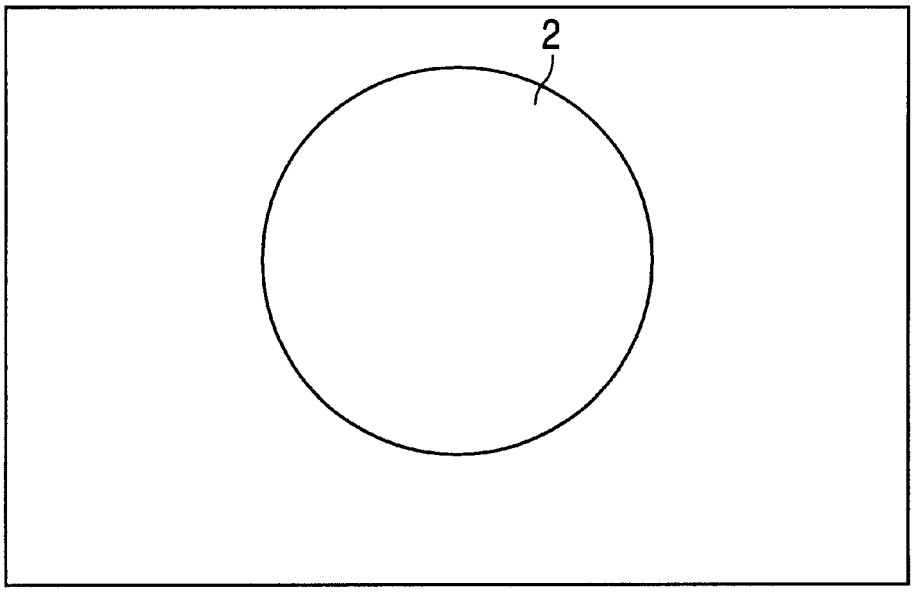
FIG. 6C shows a top view of the of FIGS. 6A & 6B.
Figure 6B:
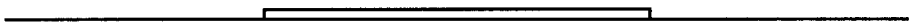
FIG. 6B shows a front view of the base of FIG. 6A.
Figure 6A:
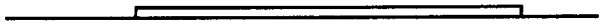
FIG. 6A shows a side view of the base of a roof vent in accord with any of FIGS. 1, 2, 4B and 5B.

FIG. 6A shows a side view of the base of the roof vent of either the preferred or the alternative embodiment. FIG. 6B shows a front view of the base of FIG. 6A and FIG. 6C shows a top view of the base of FIGS. 6A & 6B.

What is claimed is:

1. A roof vent, comprising:

a substantially planar base having an opening defined therein for the passage of air therethrough;

a cover over said base having a first exterior louvre for passage of air therethrough;

a side wall substantially enclosing an interior volume of the vent by connecting said base and said cover;

a first interior louvre located between said base and said cover and between said opening defined in said base and said first exterior louvre, such that matter passing through said vent via said first exterior louvre and said opening in said base must also substantially flow through said first interior louvre said first interior louvre is substantially perpendicular to said first exterior louvre.

2. The roof vent of claim 1, wherein said first interior louvre includes two strips each having slats and providing support to the vent, said first interior louvre being configured such that matter passing through said first interior louvre must substantially flow through slats of each of said two strips.

3. The roof vent of claim 2, wherein said first interior louvre and said side wall each contact the base and the cover to maintain a spacing therebetween.

4. The roof vent of claim 3, further comprising a supporting rib which also contacts the base and the cover to maintain the spacing therebetween.

5. The roof vent of claim 1, wherein an opening is defined in the side wall.

6. The roof vent of claim 5, further comprising a second interior louvre between said base and said cover for passage of air therethrough, said second interior louvre being located between said opening defined in said base and said opening defined in said side wall such that air passing through said vent between said opening in said side wall and said opening in said base must also substantially flow through said second interior louvre.

7. The roof vent of claim 6, wherein the first and second interior louvres and the side wall each contact the base and the cover to maintain a spacing therebetween.

8. The roof vent of claim 1, further comprising a second interior louvre between said base and said cover for passage of air therethrough, and wherein said cover further has a second exterior louvre for passage of air therethrough, said second interior louvre being located between said opening defined in said base and said second exterior louvre such that air passing through said vent between said second exterior louvre and said opening in said base must also substantially flow through said second interior louvre.

9. The roof vent of claim 8, wherein said first and second interior louvres are substantially perpendicular to said first and second exterior louvres.

10. The roof vent of claim 9, wherein said first and second interior louvres each include two strips having slats and providing support to the vent, said first and second interior louvres being configured such that matter passing through one of said first and second interior louvres must substantially flow through slats of each of said two strips.

11. The roof vent of claim 10, wherein said first and second interior louvres and the side wall each contact the base and the cover to maintain a spacing therebetween.

12. The roof vent of claim 11, further comprising a supporting rib which also contacts the base and the cover to maintain the spacing therebetween.

13. The roof vent of claim 8, wherein an opening is defined in the side wall.

14. The roof vent of claim 13, further comprising a third interior louvre between said base and said cover for passage of air therethrough, said second exterior louvre being located between said opening defined in said base and said opening defined in said side wall such that air passing through said vent between said opening in said side wall and said opening in said base must also substantially flow through said second interior louvre.

15. The roof vent of claim 14, wherein said first, second and third interior louvres and the side wall each contact the base and the cover to maintain a spacing therebetween.

16. The roof vent of claim 14, wherein said first, second and third interior louvres are connected to prevent matter from flowing between them.

17. The roof vent of claim 16, wherein an end of said first interior louvre is connected to an end of said third interior louvre, and an end of said second interior louvre is connected to the other end of said third interior louvre.

18. The roof vent of claim 17, wherein said first and second interior louvres are extended at their respective other ends to the side wall to prevent matter from flowing between said other ends of said first and second interior louvres and said side wall.

19. The roof vent of claim 1, further comprising a mesh over said opening defined in said base to prevent solid and liquid matter from passing therethrough.

* * * * *